United States Patent [19]

Griesinger et al.

[11] 4,150,462

[45] Apr. 24, 1979

[54] DRAW FRAME DEVICE FOR SPINNING MACHINES

[75] Inventors: Rolf Griesinger, Goppingen-Faurndau; Manfred Rienhardt, Donzdorf, both of Fed. Rep. of Germany

[73] Assignee: Spindelfabrik Süssen Schurr, Stahlecker & Grill GmbH, Fed. Rep. of Germany

[21] Appl. No.: 785,282

[22] Filed: Apr. 6, 1977

[30] Foreign Application Priority Data

Apr. 17, 1976 [DE] Fed. Rep. of Germany ..... 2616957

[51] Int. Cl.[2] ..... D01H 5/56

[52] U.S. Cl. ..... 19/294; 57/315

[58] Field of Search ..... 57/1 R, 36; 19/294–295

[56] References Cited

U.S. PATENT DOCUMENTS

| | | | |
|---|---|---|---|
| 241,851 | 5/1881 | Essex et al. | 19/294 X |
| 2,557,658 | 6/1951 | Hoffmann | 57/36 |
| 2,923,119 | 2/1960 | Nifenecker | 57/1 R |
| 2,932,068 | 4/1960 | Cole | 19/294 X |
| 3,381,458 | 5/1968 | Rajnoba et al. | 57/1 R |

*Primary Examiner*—Charles Gorenstein

*Attorney, Agent, or Firm*—Craig & Antonelli

[57] ABSTRACT

A draw frame device for spinning machines is provided which includes a preassembled auxiliary draw frame stand formed of a hollow longitudinal pipe member having a plurality of supports welded thereto. The supports are configured for holding supporting rods for supporting upper rolls and loading arms, as well as for supporting lower rolls of a draw frame. Adjustable fastening means are provided at each of the respective opposite ends of the longitudinal member for adjustably connecting the preassembled auxiliary draw frame stand to a hollow longitudinal draw frame stand member of a spinning machine.

17 Claims, 3 Drawing Figures

DRAW FRAME DEVICE FOR SPINNING MACHINES

BACKGROUND AND SUMMARY OF THE INVENTION

The invention relates to a draw frame device for spinning machines, especially of the type wherein supporting rods for upper roll support and loading arms and also for lower rolls are held by supports disposed on the spinning machine.

In known constructions (French Pat. No. 1,491,667 and German Utility Model No. 1,971,929) the roll supports are fixed on longitudinal members of the machine, on "draw frame stands". In these constructions, it is provided that the roll supports be first disposed on the draw frame stand, whereafter the lower rolls and the supporting rods for the upper roll support and loading arms are put in place. Here supporting rods are provided whose length corresponds to the distance between roll supports in the longitudinal direction of the machine. The setting up of the draw frame is time consuming and expensive work because of this arrangement. This work has to be repeated if the spinning machine is to be modernized by being re-equipped with new draw frames. Also, this work then has to be done in the spinning shop and not in the draw frame manufacturing plant, which leads to more difficulties and possibly to inaccuracies in assembling.

The invention is intended at least in part, to develop a draw frame device with which it is possible easily to equip and modernize an already existing spinning machine with new draw frames, avoiding the danger of assembling errors and the like. The invention contemplates providing a plurality of roll supports forming a pre-assembled unit with a long shaped member, which long shaped member serves as an auxiliary draw frame stand and is provided with attachment surfaces and/or attaching means, for disposition on a draw frame stand of the spinning machine.

By this arrangement it is possible to preassemble a group of several draw frames in the manufacturing plant as a module which then can be disposed as a whole on a spinning machine. The preassembled draw frames can be checked for functional efficiency at the plant, which generally has better measuring and testing instruments, because they go onto the spinning machine in their preassembled state. The danger of assembling error and inaccuracy is generally excluded. The auxiliary draw frame stand entails more expense in initial manufacture of course, but this is offset by savings in assembling time.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
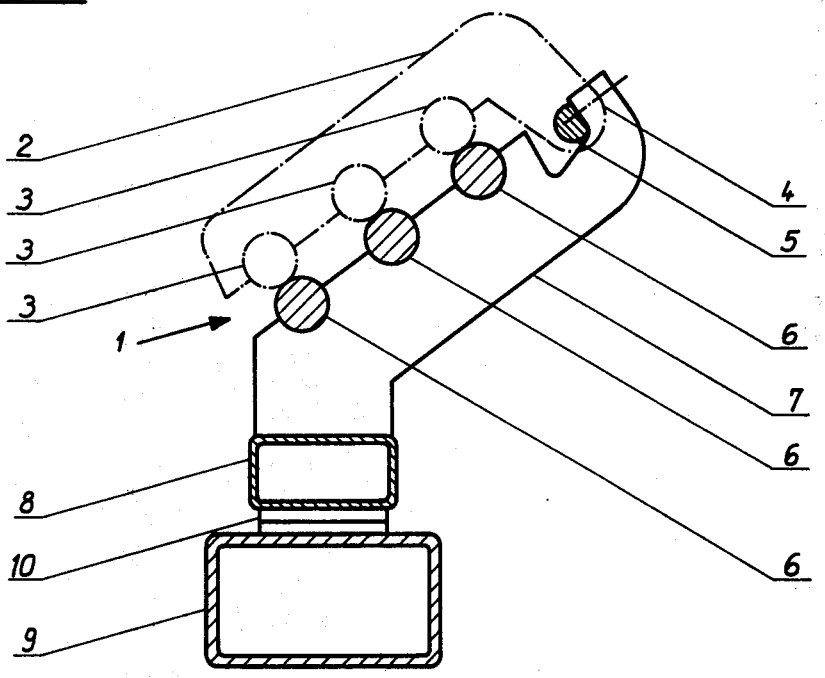
FIG. 1 is a sectional view through a draw frame device constructed in accordance with a preferred embodiment of the invention.
Figure 2:
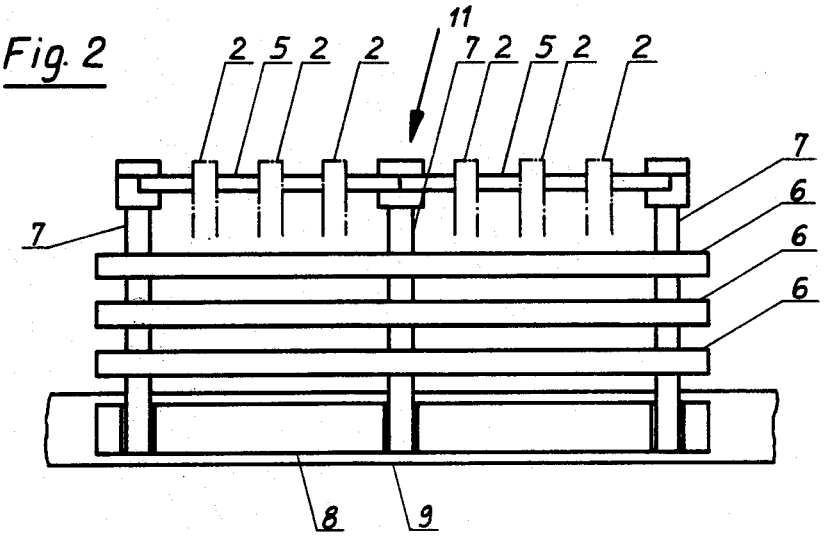
FIG. 2 is a partial schematic top view of the draw frame device of FIG. 1, made as a modular section.

The draw frame of FIG. 1 has an upper roll supporting and loading arm 2 indicated by dot-and-dash lines, which holds upper rolls 3, likewise indicated by dot-and-dash lines. The upper roll supporting and loading arm 2 is fixed on a supporting rod 5 by means of a connecting piece 4 which is integral therewith or made as an intermediate member. Supporting rod 5 is accepted by supports 7 that also serve to receive lower rolls 6. The length of supporting rods 5, in the illustrated embodiment (FIG. 2) corresponds to the distance between two supports 7, i.e. the bearing distance over which lower rolls 6 are borne by supports 7. As FIG. 2 shows, a plurality of upper roll supporting and loading arms 2 (namely three arms 2) are held by each supporting rod 5. In the FIG. 2 illustration only portions of arms 2 are shown and rollers 3 are not shown in order to better illustrate the remaining modular draw frame construction.

Supports 7 along with a longitudinal member 8 constitute a structural unit, said longitudinal member 8 in the illustrated embodiment being a flat-lying four-sided pipe. The supports 7 are fixed by welding on this longitudinal member 8 in the preferred illustrated embodiment. The frame formed by supports 7 and longitudinal member 8 makes it possible to dispose thereon lower rolls 6 and supporting rods 5, as well as upper roll support and loading arms 2, so that a preassembled module of a group of draw frames is produced which can be adjusted in the manufacturing plant. Longitudinal member 8 of the preassembled unit made in this way is then placed on a draw frame stand 9 of a spinning machine as indicated in FIG. 1, which frame stand 9 may also be made as a hollow element. Advantageously, between longitudinal member 8 which serves as an auxiliary draw frame stand, and the draw frame stand 9 of the spinning machine, fastening means 10 that permit adjustment in height, depth and tilt are provided.

Figure 3:
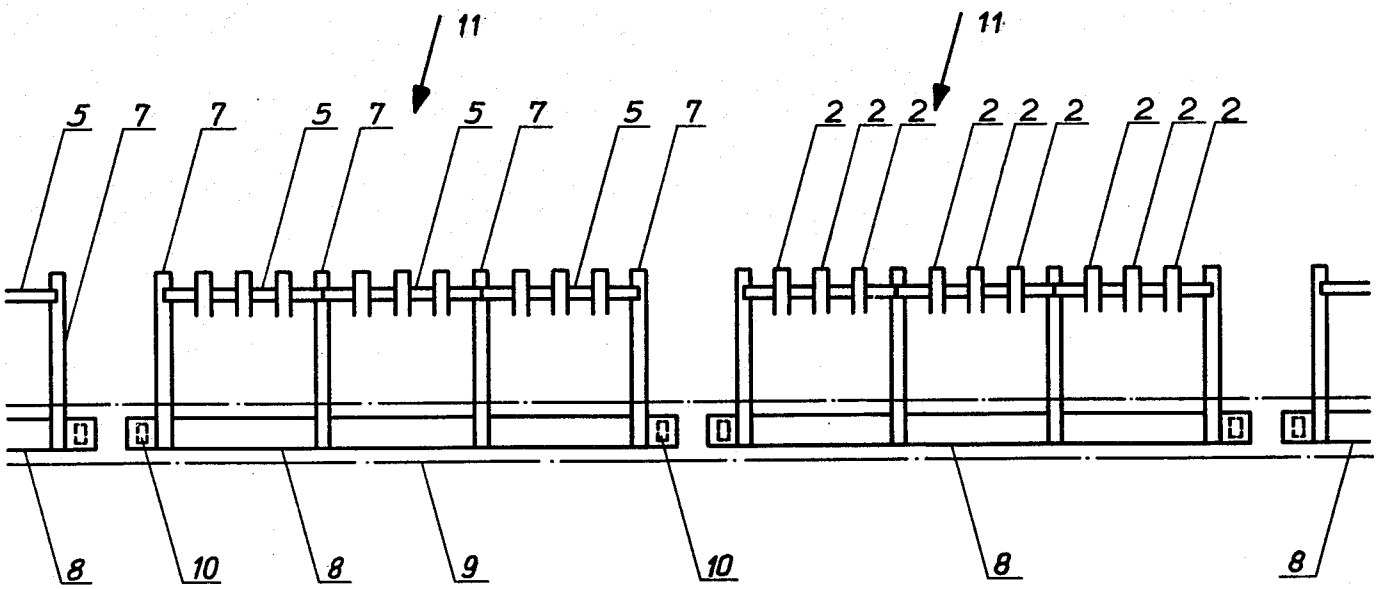
FIG. 3 is a schematic top view representation of a plurality of draw frame sections disposed on a spinning machine, and constructed according to the invention.

As FIGS. 2 and 3 show, the draw frame groups are made up as modular sections 11, whereby it is provided that the said modules are made in such a way that the length of the lower rolls 6 corresponds to the length of the auxiliary draw frame stand member 8. Fastening means 10 are advantageously located in the region of the ends of auxiliary draw frame stand members 8, so that members 8 are fixed on frame stand 9 of a spinning machine and can be fixed on available devices and mutually disposed so that no assembling errors will occur.

With the indicated draw frame arrangement, it is possible to produce draw frame groups in section modules which can be built onto existing spinning machines as prefabricated manufacturer-tested units, without the need for time consuming operations on the spinning machine or in the shop. The danger of assembling errors or inaccuracies is largely avoided. The efficiency of the individual draw frames can be checked on at the manufacturer's plant, so that this matter does not entail any difficulty either, because the draw frames will be operational when they are built into already existing machines.

Differing from the arrangement of FIG. 2, it is provided in other preferred non-illustrated embodiments that lower rolls 6 end in the region of the bearings of outer supports 7, so that the coupling places between lower rolls 6 may have a bearing. This applies primarily for embodiments where special connecting elements are omitted, and where the ends of the lower roll cylinders mutually engage. In practice it is also advantageous because of tolerances, if the auxiliary draw frame stand members 8 be of such dimensions that their ends will not abut directly against one another.

While we have shown and described various embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Draw frame device for spinning machines comprising:

(i) a preassembled auxiliary draw frame stand including:

a plurality of upper draw frame rolls, a plurality of lower draw frame rolls, a longitudinal member, a plurality of supports spaced from one another and connected to said longitudinal member, said supports including means for bearingly directly supporting said lower rolls, loading arm means supportingly engaging said upper rolls, and supporting means carried by said supports and interconnecting said loading arm means to said supports, said supporting means including a member separate from both the supports and the loading arm means, (ii) and fastening means for fastening said preassembled auxiliary draw frame stand to a draw frame stand of a spinning machine.

2. Device according to claim 1, further comprising a longitudinally extending spinning machine draw frame stand of a spinning machine, wherein said fastening means includes means for fastening said longitudinal member to said spinning machine draw frame stand.

3. Device according to claim 2, wherein said spinning machine draw frame stand is formed as a hollow shaped element.

4. Device according to claim 1, wherein the length of the longitudinal member corresponds to the length of the lower rolls.

5. Device according to claim 1, wherein said fastening means includes adjustable fastening means that are adjustable in height and/or tilt and which are located at each of the respective opposite ends of the longitudinal member.

6. Device according to claim 4, wherein said fastening means includes adjustable fastening means that are adjustable in height and/or tilt and which are located at each of the respective opposite ends of the longitudinal member.

7. Device according to claim 1, wherein the longitudinal member of the auxiliary draw frame stand comprises a hollow shaped element.

8. Device according to claim 7, wherein a four-sided pipe is provided as the longitudinal member of the auxiliary draw frame stand.

9. Device according to claim 1, wherein said plurality of supports includes at least three supports spaced from one another in the longitudinal direction of said rolls and connected to said longitudinal member.

10. Device according to claim 9, wherein said loading arm means includes more than two loading arms spaced from one another in the longitudinal direction of said rolls and positioned between respective adjacent ones of said supports.

11. Device according to claim 10, wherein said supporting rod means are located and supported at respective upper ends of said supports.

12. Draw frame device for spinning machines comprising:

(i) a preassembled auxiliary draw frame stand including:

a plurality of upper draw frame rolls, a plurality of lower draw frame rolls, a longitudinal member, a plurality of supports spaced from one another and connected to said longitudinal member, said supports including means for bearingly directly supporting said lower rolls, loading arm means supporting engaging said upper rolls, and supporting means carried by said supports and interconnecting said loading arm means to said supports, (ii) and fastening means for fastening said preassembled auxiliary draw frame stand to a draw frame stand of a spinning machine, wherein said loading arm means includes more than two loading arms spaced from one another in the longitudinal direction of said rolls and positioned between respective adjacent ones of said supports.

13. Device according to claim 12, wherein three of said loading arms are positioned between respective adjacent ones of said supports.

14. Draw frame device for spinning machines comprising:

(i) a preassembled auxiliary draw frame stand including:

a plurality of upper draw frame rolls, a plurality of lower draw frame rolls, a longitudinal member, a plurality of supports spaced from one another and connected to said longitudinal member, said supports including means for bearingly directly supporting said lower rolls, loading arm means supportingly engaging said upper rolls, and supporting means carried by said supports and interconnecting said loading arm means to said supports, (ii) and fastening means for fastening said preassembled auxiliary draw frame stand to a draw frame stand of a spinning machine, wherein said supporting means includes supporting rod means interconnecting said supports with said loading arm means.

15. Device according to claim 14, wherein said plurality of supports includes at least three supports spaced from one another in the longitudinal direction of said rolls and connected to said longitudinal member.

16. Device according to claim 14, wherein said supporting rod means are located and supported at respective upper ends of said supports.

17. Device according to claim 14, wherein said loading arm means and upper rolls are connected to said supports by way of said supporting rod means without a direct connection of the loading arm means upper rolls to said supports.

* * * * *